US009970220B2

(12) United States Patent
Hiramoto et al.

(10) Patent No.: US 9,970,220 B2
(45) Date of Patent: May 15, 2018

(54) VEHICLE DOOR LATCH DEVICE

(71) Applicant: MITSUI KINZOKU ACT CORPORATION, Kanagawa (JP)

(72) Inventors: Shigenori Hiramoto, Kanagawa (JP); Naoki Hanaki, Kanagawa (JP); Kohei Yamashita, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 0 days. days.

(21) Appl. No.: 15/133,980

(22) Filed: Apr. 20, 2016

(65) Prior Publication Data

US 2016/0312500 A1 Oct. 27, 2016

(30) Foreign Application Priority Data

Apr. 24, 2015 (JP) ..... 2015-089883

(51) Int. Cl.

| | |
|---|---|
| ***E05B 79/20*** | (2014.01) |
| ***E05B 81/16*** | (2014.01) |
| ***E05B 81/90*** | (2014.01) |
| ***E05B 83/40*** | (2014.01) |
| ***E05B 81/24*** | (2014.01) |

(52) U.S. Cl.

CPC ..... *E05B 81/90* (2013.01); *E05B 79/20* (2013.01); *E05B 81/16* (2013.01); *E05B 81/25* (2013.01); *E05B 83/40* (2013.01)

(58) Field of Classification Search

CPC ..... E05B 81/90; E05B 79/20; E05B 85/26; E05B 85/243; E05B 81/16; E05B 83/40

See application file for complete search history.

(56) References Cited

U.S. PATENT DOCUMENTS 9,650,816 B2 * 5/2017 Okuma ..... E05B 81/20
2015/0204113 A1 * 7/2015 Machida ..... E05B 77/265 292/336.3

FOREIGN PATENT DOCUMENTS

| | | |
|---|---|---|
| JP | 2005-213818 A | 8/2005 |
| JP | 2014-074324 A | 4/2014 |
| JP | 2014-152496 A | 8/2014 |

* cited by examiner

*Primary Examiner* — Matthieu F Setliff
*Assistant Examiner* — Thomas L Neubauer
(74) *Attorney, Agent, or Firm* — McDermott Will & Emery, LLP

(57) ABSTRACT

A vehicle door latch device includes: a latch unit configured to keep a vehicle door in a door-closed state by engaging with a striker of a vehicle body; a power release mechanism configured to make the vehicle door openable by releasing engagement between the latch unit and the striker; a disengagement mechanism installed in a path coupling the power release mechanism with the latch unit, the disengagement mechanism being configured to be switched between a connected state and a disconnected state; and a lever configured to switch the disengagement mechanism from the connected state to the disconnected state. The lever is configured to be connectable to both of a full-open position holder, operating when the vehicle door reaches a full-open position by door-opening slide, and a disengagement operating unit for manual operation.

7 Claims, 5 Drawing Sheets

VEHICLE DOOR LATCH DEVICE

CROSS-REFERENCE TO RELATED APPLICATION(S)

The present application claims priority to and incorporates by reference the entire contents of Japanese Patent Application No. 2015-089883 filed in Japan on Apr. 24, 2015.

BACKGROUND OF THE INVENTION

1. Field of the Invention

The disclosure relates to a vehicle door latch device with a power release mechanism, and in particular, it relates to a ratchet path disengagement mechanism provided in a ratchet release transmission path that transmits ratchet release operation force from the power release mechanism to a ratchet.

2. Description of the Related Art

There has been publicly known a convention vehicle door latch device as illustrated in FIG. 10 provided with a latch B that abuts on a striker A of a vehicle body when a vehicle door moves in a door-closing direction and rotates from an unlatch position to a latch position, a ratchet E that prevents a reversal of the latch B and holds the door in a door-closed state by engaging with a half latch step portion C and a full latch step portion D of the latch B, and a motor-type power release mechanism G coupled to the ratchet E through a ratchet release transmission path F, and in which door-opening is enabled by transmitting ratchet release operation force from the power release mechanism G to the ratchet E through the ratchet release transmission path F and by rotating the ratchet E against elasticity of a ratchet spring H such that it is released from the latch B. The vehicle door latch device provided with such power release mechanism G is frequently used in a sliding vehicle door.

In the above-described publicly known device, when a failure (motor failure, power supply failure, gear chipping, etc.) occurs to the power release mechanism G during operation, a power system of the power release mechanism G enters mechanical lock state, and the ratchet E, which is coupled to the power release mechanism G through the ratchet release transmission path F, also becomes inoperative accompanying the above-described mechanical lock state. The ratchet E becomes incapable of rotating in a direction to engage with the latch B, and door-closing may be incomplete. For this reason, a ratchet path disengagement mechanism J that switches from a "connected state" to a "disconnected state" is provided in the middle of the ratchet release transmission path F such that, when the ratchet E is bound at a releasing position due to the mechanical lock state of the power release mechanism G and becomes incapable of reengaging with the latch B, coupling between the power release mechanism G and the ratchet E is detached and that the ratchet E can be reengaged with the latch B by only the elasticity of the ratchet spring H even in a case where the power release mechanism G is in the mechanical lock state.

A ratchet path disengagement mechanism according to Japanese Patent Application Laid-open No. 2005-213818 is switched from the "connected state" to the "disconnected state" by a special method of using an existing component, whereby an end user is unable to deal with it.

A ratchet path disengagement mechanism according to Japanese Patent Application Laid-open No. 2014-074324 is switched from the "connected state" to the "disconnected state" by moving the door to close it, by rotating a latch in a latch direction by abutting it on a striker, and by interlockingly displacing an interlocking lever, whereby interlocking displacement force of the interlocking lever is transmitted to the ratchet path disengagement mechanism. In this configuration, it is necessary to add the interlocking lever that interlocks with rotation of the door-closing latch to a small door-closing latch unit (latch and ratchet mechanism). In many cases, a power close mechanism is connected to the door-closing latch, and adding of the interlocking lever may put a large burden on designing. In addition, since disengagement of the ratchet path disengagement mechanism is performed each time the door is closed, whereby operation noise thereof may also become a large problem.

A ratchet path disengagement mechanism according to Japanese Patent Application Laid-open No. 2014-152496 is switched from the "connected state" to the "disconnected state" by operating a specialized button provided on the door. Thus, although peculiarity of the ratchet path disengagement mechanism of Japanese Patent Application Laid-open No. 2005-213818 is avoided, existence of the button is not known to the end user, whereby it may not be a sufficient measure for emergency such as "the door does not close".

SUMMARY OF THE INVENTION

It is an object of the present invention to at least partially solve the problems in the conventional technology.

In some embodiments, a vehicle door latch device includes: a latch unit configured to keep a vehicle door in a door-closed state by engaging with a striker of a vehicle body; a power release mechanism configured to make the vehicle door openable by releasing engagement between the latch unit and the striker; a disengagement mechanism installed in a path coupling the power release mechanism with the latch unit, the disengagement mechanism being configured to be switched between a connected state and a disconnected state; and a lever configured to switch the disengagement mechanism from the connected state to the disconnected state. The lever is configured to be connectable to both of a full-open position holder, operating when the vehicle door reaches a full-open position by door-opening slide, and a disengagement operating unit for manual operation.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
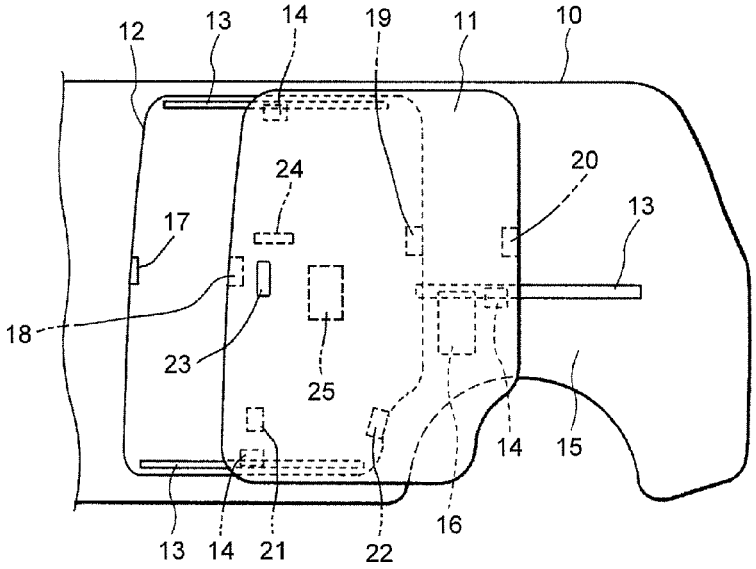
FIG. 1 is a side view illustrating a vehicle body provided with a vehicle door latch device according to an embodiment of the present invention.

An embodiment of a vehicle door latch device with a power release mechanism according to the present invention is described with reference to the drawings. In FIG. 1, there are illustrated a vehicle body 10, a vehicle door 11 slidably attached to the vehicle body 10, and a door opening 12 that may be blocked by the vehicle door 11. To the vehicle body 10, a plurality of guide rails 13 is fixed in a front-back direction. A bracket 14 that slidably engages with each of the guide rails 13 is provided to the vehicle door 11. The vehicle door 11 is attached to the vehicle body 10 slidably in the front-back direction.

In an internal space of a quarter panel 15, which is a rear side surface of the vehicle body 10, there is provided a power slide device 16 for moving the vehicle door 11 in the front-back direction to open or close it by motor power.

A front striker 17 is provided to a front end of the door opening 12, and a front latch unit 18 that engages with the front striker 17 is provided to a front end of the vehicle door 11. A rear striker 19 is provided to a rear end of the door opening 12, and a rear latch unit 20 that engages with the rear striker 19 is provided to a rear end of the vehicle door 11. As is well known, each of these latch units is provided with a latch and a ratchet and keeps the vehicle door 11 in a door-closed state by engaging with a striker.

The vehicle door 11 is provided with a full-open position holder 21 having a latch and a ratchet. When the vehicle door 11 is moved to a predetermined full-open position by door-opening sliding, the full-open position holder 21 engages with a striker-shaped full-open stopper 22, which is fixed to the vehicle body 10, and holds the vehicle door 11 in a full-open position.

An outside open handle 23 is provided on an exterior side of the vehicle door 11, and an inside open handle 24 is provided on an interior side of the vehicle door 11. Preferably, the outside open handle 23 and the inside open handle 24 are functionally coupled to the front latch unit 18, the rear latch unit 20, and the full-open position holder 21 through an operation relay device 25 provided inside the vehicle door 11. By operating the open handles 23 and 24, engagement is released between the latch units 18 and 20 and the strikers 17 and 19, respectively, whereby the vehicle door 11 becomes door-openable, or engagement is released between the full-open position holder 21 and the full-open stopper 22, whereby it becomes door-closable.

Figure 2:
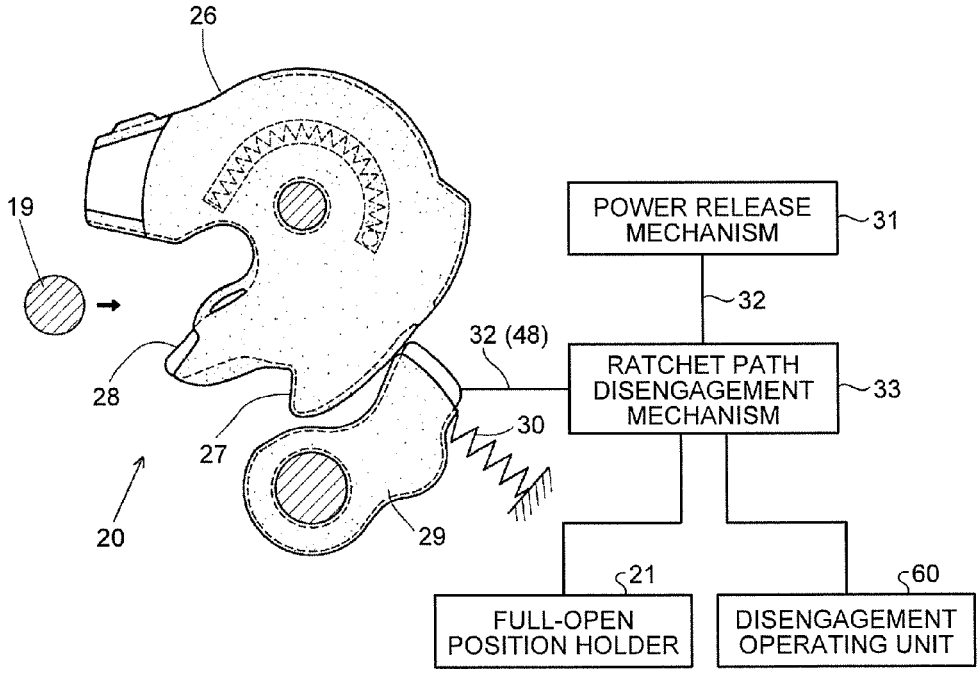
FIG. 2 is a relationship diagram illustrating a relationship between a rear latch unit and a principal part of the vehicle door latch device.

As illustrated in FIG. 2, the rear latch unit 20 is provided with a latch 26 that abuts on the rear striker 19 of the vehicle body 10 when the vehicle door 11 moves in a door-closing direction and rotates from an unlatch position to a latch position, and a ratchet 29 that keeps the vehicle door 11 in the door-closed state by engaging with a half latch step portion 27 and a full latch step portion 28 of the latch 26 and preventing a reversal of the latch 26. The ratchet 29 is energized toward the latch 26 by elasticity of a ratchet spring 30. Note that the front latch unit 18 is configured substantially the same.

Near the rear latch unit 20 or near the operation relay device 25, a motor type power release mechanism 31 is provided. The power release mechanism 31 is coupled to the ratchet 29 through a ratchet release transmission path 32. The power release mechanism 31 is started based on an operation signal from a door switch, a portable wireless switch, and the like (not illustrated) provided to the vehicle body 10. Ratchet release operation force from the power release mechanism 31 is transmitted to the ratchet 29 through the ratchet release transmission path 32. The ratchet 29 rotates in a direction to break away from the latch 26 against elasticity of the ratchet spring 30, and when the ratchet 29 reaches a releasing position, the latch 26 is released, whereby the vehicle door 11 enters a door-closable state.

In the middle of the ratchet release transmission path 32, there is provided a ratchet path disengagement mechanism 33 that is switched between a "connected state" and a "disconnected state". The ratchet path disengagement mechanism 33 is switched from the "connected state" to the "disconnected state" while the vehicle door 11 moves toward the full-open position by the door-opening sliding and the full-open position holder 21 abuts on and fully engages with the full-open stopper 22 of the vehicle body 10, and it recovers to the "connected state" again. Switching of a disengagement state of the ratchet path disengagement mechanism 33, as described below, is brought about by displacement force of the full-open position holder 21, which is displaced as it abuts on the full-open stopper 22. The ratchet path disengagement mechanism 33 may be installed in any place as long as it in the middle of the ratchet release transmission path 32; however, preferably, it is installed near the power release mechanism 31.

When the ratchet path disengagement mechanism 33 is in the disconnected state, only very small cable resistance acts on the ratchet 29. Thus, even though a failure or the like occurs in the power release mechanism 31, the ratchet 29 is not affected thereby and is capable of abutting on and engaging with the latch 26 at a predetermined energizing pressure set by the elasticity of the ratchet spring 30. Note that a ratchet (not illustrated) of the front latch unit 18 is also coupled to the power release mechanism 31 through the ratchet path disengagement mechanism 33.

Figure 3:
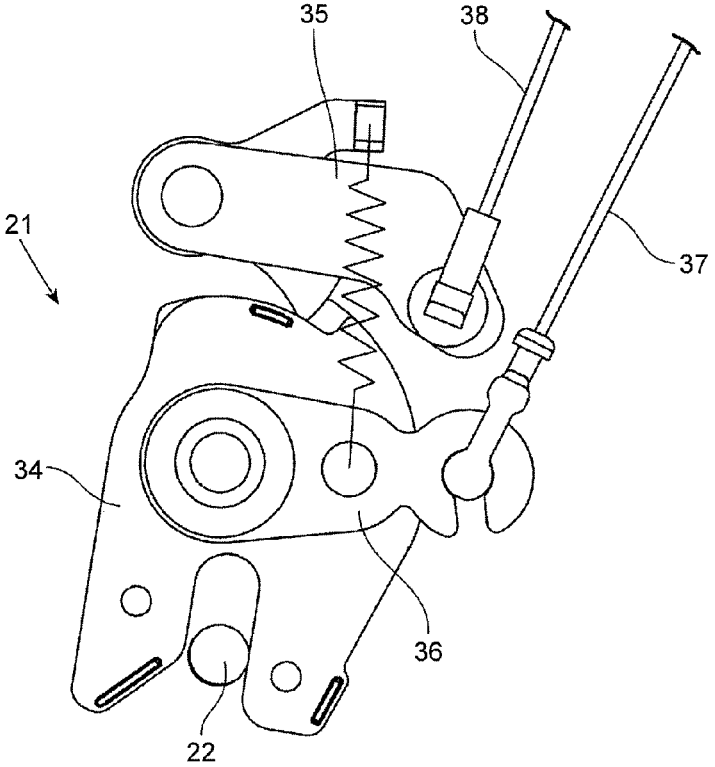
FIG. 3 is a side view illustrating a full-open position holder and a full-open stopper of the vehicle door latch device.

In FIG. 3, the full-open position holder 21 and the full-open stopper 22 are illustrated. The full-open position holder 21 has a structure similar to that of the rear latch unit 20, and is provided with a full-open latch 34 that abuts on the full-open stopper 22 of the vehicle body 10 when the vehicle door 11 reaches the full-open position by the door-opening sliding and rotates from the unlatch position to the latch position, and a full-open ratchet 35 that keeps the vehicle door 11 in the full-open position by engaging with the full-open latch 34 and preventing a reversal of the full-open latch 34. To the full-open latch 34, a latch lever 36 is fixed so as to be interlockingly rotating. To a tip of the latch lever 36, a cable 37 extending to the ratchet path disengagement mechanism 33 is connected. A reference numeral 38 denotes a cable that releases the full-open ratchet 35 from the full-open latch 34 by power of the power release mechanism 31.

Figure 4:
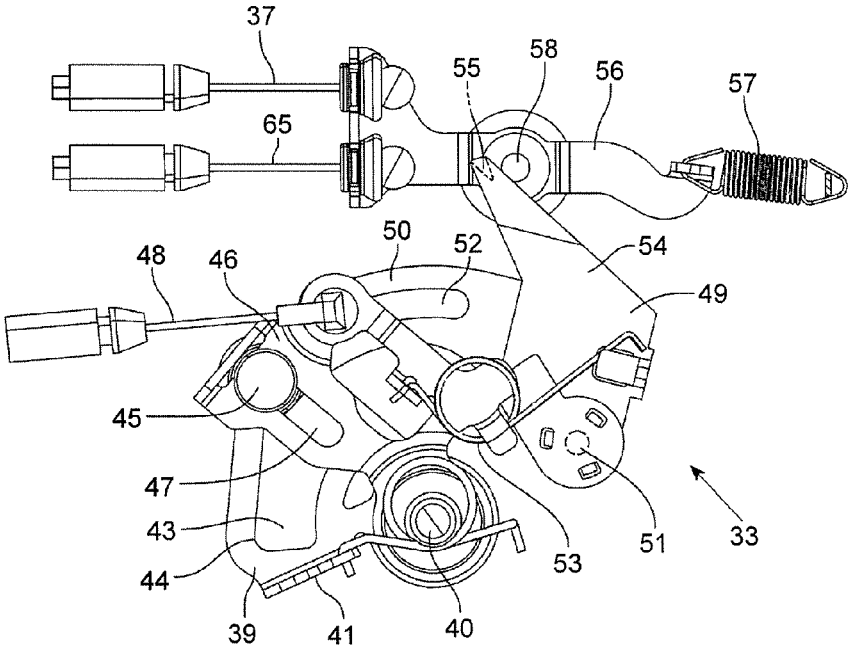
FIG. 4 is a front view illustrating a ratchet path disengagement mechanism of the vehicle door latch device.
Figure 5:
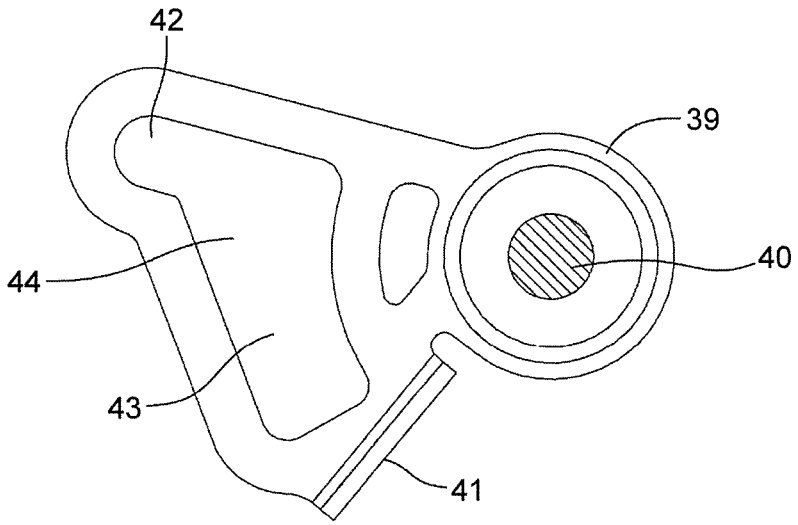
FIG. 5 is a front view of a drive lever of the ratchet path disengagement mechanism.

FIG. 4 illustrates the ratchet path disengagement mechanism 33, and preferably, the ratchet path disengagement mechanism 33 is integrally provided near the power release mechanism 31. A reference numeral 39 denotes a drive lever that rotates centering on a shaft 40 (FIG. 5). The ratchet release operation force from the power release mechanism 31 is transmitted to a bending wall 41 of the drive lever 39. When the power release mechanism 31 is started, the drive lever 39 rotates clockwise in FIG. 4. In the drive lever 39, an opening 44 constituted of an engagement recessed portion 42 and a non-hitting 43 is formed, and a clutch pin 45 is inserted into the opening 44.

Figure 6:
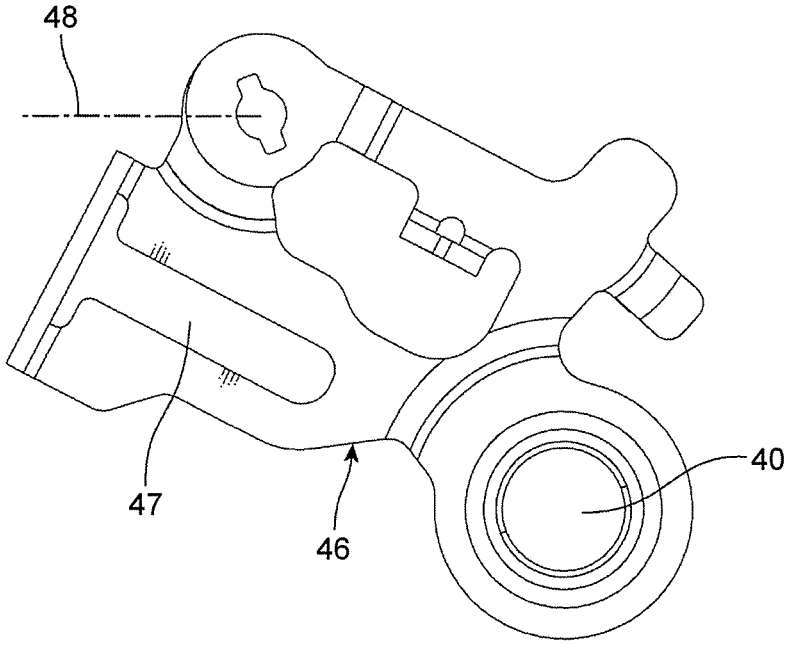
FIG. 6 is a front view of a release lever of the ratchet path disengagement mechanism.

A release lever 46 (FIG. 6), arranged so as to overlap with the drive lever 39, is supported about the shaft 40. A release slot 47 extending in a radiation direction of the shaft 40 is formed in the release lever 46. The clutch pin 45 is inserted into the release slot 47 being approachable to and separable from the shaft 40. To an end portion of the release lever 46, one end of a cable 48 extending to the ratchet 29 (and a ratchet of the front latch unit 18) is coupled.

The clutch pin 45, when separated from the shaft 40, faces inside of the engagement recessed portion 42 of the drive lever 39. Accordingly, clockwise rotation of the drive lever 39 is transmitted to the release lever 46 through the clutch pin 45, and the ratchet 29 is released from the latch 26 through the cable 48 (this state is the "connected state" of the ratchet path disengagement mechanism 33). When the clutch pin 45 approaches the shaft 40, however, the clutch pin 45 faces inside of the non-hitting hole 43, whereby the clockwise rotation of the drive lever 39 is no longer transmitted to the release lever 46 (this state is the "disconnected state" of the ratchet path disengagement mechanism 33).

Figure 7:
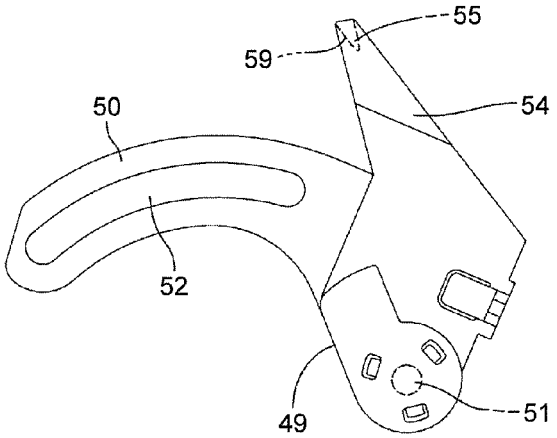
FIG. 7 is a front view of a disengagement lever of the ratchet path disengagement mechanism.

Between the drive lever 39 and the release lever 46, an arc-shaped nose portion 50 of a disengagement lever 49 is faced (FIG. 7). The disengagement lever 49 rotates centering on a shaft portion 51, which is parallel to the shaft 40. The arc-shaped nose portion 50 is provided with an arc slot 52 into which the clutch pin 45 is inserted. When the disengagement lever 49 is maintained in a state of being rotated in a clockwise rotation direction by an energizing spring 53 (state in FIG. 4), the clutch pin 45 is maintained in a state of being engaged with the engagement recessed portion 42.

The disengagement lever 49 is provided with an extended portion 54 extending in a radiation direction of the shaft portion 51. On a lower surface at a tip of the extended portion 54, an abutment portion 55 protruding in parallel to the shaft portion 51 is provided.

Near the tip of the extended portion 54 of the disengagement lever 49, a slide lever 56 that rotates the disengagement lever 49 is provided. The slide lever 56 has a long rod shape, and to one end thereof, a recovery spring 57 that energizes the slide lever 56 rightward in FIG. 4 is provided, and to the other end thereof, the cable 37 extending to the full-open latch 34 (latch lever 36) of the full-open position holder 21 is coupled. At a center of the slide lever 56, an abutment pin 58 capable of engaging with the abutment portion 55 of the disengagement lever 49 is attached.

When the vehicle door 11 performs the door-opening sliding, and the full-open latch 34 of the full-open position holder 21 abuts on the full-open stopper 22 and is rotated, the cable 37 is pulled, whereby the slide lever 56 slides leftward against elasticity of the recovery spring 57 in FIG. 4. Then, the abutment pin 58 of the slide lever 56 abuts on the abutment portion 55 of the disengagement lever 49. The disengagement lever 49 makes counterclockwise rotation centering on the shaft portion 51. The clutch pin 45 being engaged with the arc slot 52 of the disengagement lever 49 is slid toward the shaft 40 along the release slot 47. Accordingly, the clutch pin 45 moves from the engagement recessed portion 42 to the non-hitting hole 43 of the drive lever 39, whereby the drive lever 39 and the release lever 46 are in the disconnected state.

In this way, each time the vehicle door 11 performs the door-opening sliding and the full-open position holder 21 is operated, the ratchet path disengagement mechanism 33 is switched from the "connected state" to the "disconnected state". The ratchet 29 is detached from the power release mechanism 31, whereby even in a case where the power release mechanism 31 enters the mechanical lock state due to a failure, the ratchet 29 performs engagement without disagreement by the elasticity of the ratchet spring 30, and door closing of the vehicle door 11 becomes possible again.

Furthermore, when the vehicle door 11 moves to the predetermined full-open position, the slide lever 56 is pulled largely leftward by the cable 37, and the abutment pin 58 of the slide lever 56 moves leftward exceeding the abutment portion 55 of the disengagement lever 49, whereby the disengagement lever 49 recovers to a connection position in FIG. 4 by elasticity of the energizing spring 53. Accordingly, the clutch pin 45 is returned to inside of the engagement recessed portion 42 of the drive lever 39 again, and the ratchet path disengagement mechanism 33 is recovered to the "connected state".

Thus, when the vehicle door 11 is released from the full-open position and performs the door-opening sliding, the full-open latch 34 of the full-open position holder 21 is released, the cable 37 is returned, and the slide lever 56, which has been pulled largely leftward from the position in FIG. 4, slides rightward by the elasticity of the recovery spring 57. At this time, there is the abutment portion 55 of the disengagement lever 49 on the right of the abutment pin 58 of the slide lever 56; however, by forming a left side surface of the abutment portion 55 into an inclined surface 59, the abutment pin 58 moves so as to detour below the abutment portion 55 in FIG. 4, whereby it is possible to prevent wrong pressure from acting on the disengagement lever 49.

In the above-described embodiment, a configuration is described in which the slide lever 56 is slid by the displacement force of the full-open position holder 21, whereby the ratchet path disengagement mechanism 33 is switched to the "disconnected state"; however, the slide lever 56 may also be slid by manual operation.

Figure 8:
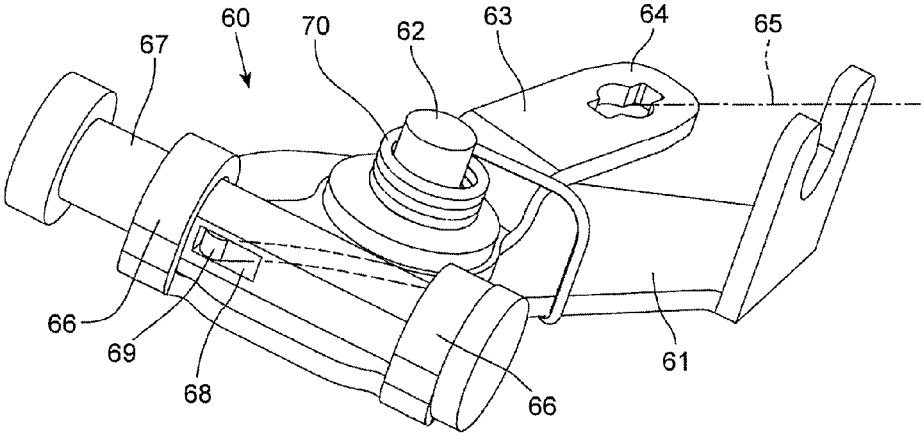
FIG. 8 is an overall perspective view illustrating a disengagement operating unit of the door latch device according to a first embodiment.

In FIG. 8, there is illustrated a disengagement operating unit 60 for manual operation according to a first embodiment. Similar to a well-known childproof operation unit, the disengagement operating unit 60 is installed in a place inoperable in a normal door-closed state. It may also be installed in a place where it is hidden by a trim plate of the vehicle door 11.

In the disengagement operating unit 60, a disengagement lever 63 is provided on a bracket 61, which is attached to the vehicle door 11. The disengagement lever 63 is supported about a shaft 62. A cable 65, which is coupled to the slide lever 56, is locked to a connection end portion 64 of the disengagement lever 63.

A pair of C-ring shaped holding portions 66 is provided to an end portion of the bracket 61, and a cylindrical operation pin 67 is movably supported in a length direction by the holding portions 66. An engagement slit 68 is formed in the operation pin 67. A tip 69 of the disengagement lever 63 is engaged with the engagement slit 68. When the operation pin 67 is pressed, it rotates the disengagement lever 63 against a spring 70 and pulls the cable 65. Accordingly, the slide lever 56 is slid, whereby the ratchet path disengagement mechanism 33 is switched to the "disconnected state" in the same way as when using the full-open position holder 21.

In addition, it is also possible to configure the disengagement operating unit 60 illustrated in FIG. 8 such that, when the vehicle door 11 moves to the full-open position, the operation pin 67 is abutted on and pressed against the vehicle body 10.

Figure 9:
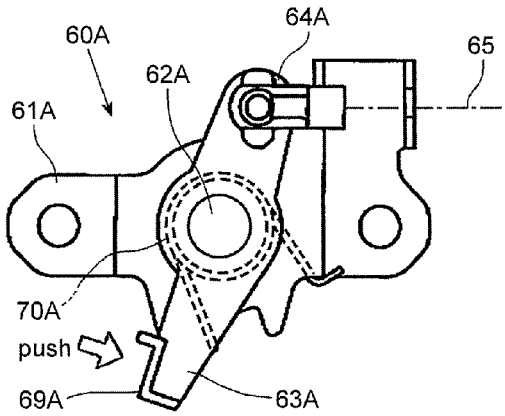
FIG. 9 is a front view illustrating a disengagement operating unit of the door latch device according to a second embodiment.
Figure 10:
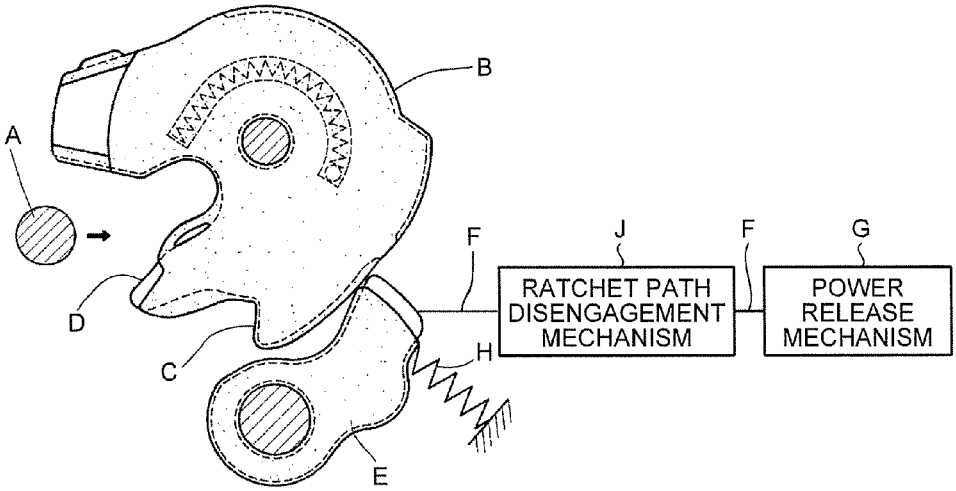
FIG. 10 is a relationship diagram illustrating a relationship between a rear latch unit and a principal part of a conventional door latch device.

In FIG. 9, there is illustrated a disengagement operating unit 60A for manual operation according to a second embodiment. The disengagement operating unit 60A is provided with a bracket 61A attached to a vehicle door 11, a disengagement lever 63A provided on the bracket 61A and supported by a shaft 62A, and a spring 70A. The cable 65, which is coupled to the slide lever 56, is locked to a connection end portion 64A of the disengagement lever 63A. In the disengagement operating unit 60A according to the second embodiment, a tip 69A of the disengagement lever 63A is manually operated directly.

Since it is possible to couple the full-open position holder 21 and/or the disengagement operating unit 60 to the slide lever 56 according to the present invention, a degree of freedom in designing is improved.

According to some embodiments, since any one or both of a full-open position holder 21 and disengagement operating units 60 and 60A can be coupled to a slide lever 56 of a ratchet path disengagement mechanism 33, it is possible to improve a degree of freedom in designing to provide the ratchet path disengagement mechanism 33 to a vehicle door having a different shape as well as to improve the degree of freedom in designing of a component for performing switching operation of the ratchet path disengagement mechanism 33 and a degree of freedom of installation place thereof.

According to some embodiments, the ratchet path disengagement mechanism 33 recovers from the disconnected state to the connected state again when operation of the full-open position holder 21 and the disengagement operating units 60 and 60A is completed, whereby the operation noise thereof is serial and may be suppressed without being conspicuous.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle door latch device comprising:

a vehicle door;

a latch unit configured to keep the vehicle door in a door-closed state by engaging with a striker of a vehicle body;

a power release mechanism configured to transmit ratchet release operation force towards the latch unit to release engagement between the latch unit and the striker;

a slide lever;

a disengagement mechanism installed in a path coupling the power release mechanism with the latch unit, the disengagement mechanism being configured to be switched from a connected state to a disconnected state by operation of the slide lever, the connected state being a state where the ratchet release operation force is transmitted to the latch unit, the disconnected state being a state where the ratchet release operation force is not transmitted to the latch unit;

a full-open position holder configured to:

operate to hold the vehicle door when the vehicle door reaches a full-open position, and cause the slide lever to operate the disengagement mechanism when the full-open position holder is connected to the disengagement mechanism; and a disengagement operating unit for manual operation, the disengagement operating unit being configured to cause the slide lever to operate the disengagement mechanism when the disengagement operating unit is connected to the disengagement mechanism, wherein the slide lever is connected to at least one of the full-open position holder and the disengagement operating unit for manual operation, the disengagement mechanism includes:

a driver lever configured to rotate around a first shaft by the ratchet release operation force of the power release mechanism and including an opening which includes a non-hitting hole and an engagement recessed portion, the non-hitting hole extending in a circumferential direction of the first shaft, the engagement recessed portion being provided at one end of the non-hitting hole;

a release lever configured to rotate around the first shaft to transmit the ratchet release operation force to the latch unit and including a release slot extending in a radial direction from the first shaft;

a clutch pin inserted into the opening and the release slot; and a first disengagement lever including an arc slot into which the clutch pin is inserted, the arc slot extending in the circumferential direction of the first shaft, the first disengagement lever being configured to rotate around a second shaft to move the clutch pin, which is engaged with the arc slot, in the release slot of the release lever in the radial direction of the first shaft by the operation of the slide lever, when the clutch pin moves in the release slot to separate from the first shaft by a rotation of the first disengagement lever, the clutch pin is positioned in the engagement recessed portion of the drive lever to cause the disengagement mechanism to be in the connected state where the release lever rotates around the first shaft via the clutch pin according to a rotation of the drive lever, and when the clutch pin moves in the release slot to approach the first shaft by a rotation of the first disengagement lever, the clutch pin is positioned in the non-hitting hole of the drive lever to cause the disengagement mechanism to be in the disconnected state where the clutch pin moves in the non-hitting hole without rotating the release lever around the first shaft according to a rotation of the drive lever.

2. The vehicle door latch device according to claim 1, wherein the disengagement mechanism is configured to be switched from the connected state to the disconnected state when the full-open position holder starts operation, and to be recovered to the connected state when the full-open position holder completes the operation.

3. The vehicle door latch device according to claim 1, wherein the disengagement mechanism is configured to be switched from the connected state to the disconnected state when the disengagement operating unit for the manual operation starts operation, and to be recovered to the connected state when the disengagement operating unit for the manual operation completes the operation.

4. The vehicle door latch device according to claim 1, wherein the full-open position holder includes:

a latch configured to move from an unlatch position to a latch position; and a ratchet configured to hold the vehicle door at the full-open position by engaging with the latch moved at the latch position, and the slide lever is operated when the latch is moved from the unlatch position to the latch position.

5. The vehicle door latch device according to claim 1, wherein the slide lever is connected to both of the full-open position holder and the disengagement operating unit.

6. The vehicle door latch device according to claim 5, wherein the disengagement operating unit is configured to cause the slide lever to switch the disengagement mechanism from the connected state to the disconnected state.

7. The vehicle door latch device according to claim 6, wherein the disengagement operating unit includes:

a second disengagement lever connected to the slide lever to rotate around a third shaft and configured to cause the slide lever to switch the disengagement mechanism from the connected state to the disconnected state by a rotation of the second disengagement lever; and an operation pin connected to the second disengagement lever and configured to rotate the second disengagement lever when the operation pin is pressed.

* * * * *